US006568028B2

(12) United States Patent
Putics et al.

(10) Patent No.: US 6,568,028 B2
(45) Date of Patent: May 27, 2003

(54) CARPET-CLEANING BRUSH

(76) Inventors: Gyöngyi Putics, Nagymezö u. 22-24, 1065 Budapest (HU); Zinaida Vonjár, Nagymezö u. 22-24, 1065 Budapest (HU)

( * ) Notice: Subject to any disclaimer, the term of this patent is extended or adjusted under 35 U.S.C. 154(b) by 0 days.

(21) Appl. No.: 09/983,907

(22) Filed: Oct. 26, 2001

(65) Prior Publication Data

US 2002/0032949 A1 Mar. 21, 2002

Related U.S. Application Data

(63) Continuation of application No. PCT/HU00/00032, filed on Apr. 13, 2000.

(30) Foreign Application Priority Data

Apr. 27, 1999 (HU) ..... 9900102 U

(51) Int. Cl.[7] ..... A47L 9/06
(52) U.S. Cl. ..... 15/367; 15/398; 15/402
(58) Field of Search ..... 15/402, 365, 367, 15/398, 400, 417

(56) References Cited

U.S. PATENT DOCUMENTS

| | | | | | |
|---|---|---|---|---|---|
| 1,571,937 | A | | 2/1926 | Frye | |
| 1,689,209 | A | | 10/1928 | Majewski | |
| 1,792,712 | A | * | 2/1931 | Roscher | 15/398 |
| 2,276,886 | A | * | 3/1942 | Smith | 132/112 |
| 3,120,851 | A | * | 2/1964 | Pollak et al. | 119/602 |
| 3,538,617 | A | * | 11/1970 | Walters | 119/606 |
| 3,744,082 | A | * | 7/1973 | Marshall | 15/142 |
| 3,745,605 | A | * | 7/1973 | Gitschel et al. | 15/364 |
| 3,929,142 | A | * | 12/1975 | Carfi | 132/271 |
| 4,042,995 | A | * | 8/1977 | Varon | 15/142 |
| 4,044,724 | A | | 8/1977 | Merchill | |
| 4,107,808 | A | | 8/1978 | Schröder | |
| 4,319,379 | A | * | 3/1982 | Carrigan et al. | 15/176.3 |
| 5,819,366 | A | * | 10/1998 | Edin | 15/322 |

FOREIGN PATENT DOCUMENTS

| | | | | |
|---|---|---|---|---|
| DE | 35 071 | | 1/1965 | |
| DE | 41 12 382 | A1 | 10/1992 | |
| DE | 195 00 008 | A1 | 7/1995 | |
| FR | 2 366 815 | | 5/1978 | |
| GB | 708418 | * | 5/1954 | 15/402 |

* cited by examiner

*Primary Examiner*—Chris K. Moore
(74) *Attorney, Agent, or Firm*—Burns, Doane, Swecker & Mathis, LLP

(57) ABSTRACT

A carpet-cleaning brush, particularly for use in cleaning rugs or carpets soiled by the hair of animals kept in the room. The brush has bristles in the form of an angle or arc, a brush body for receiving the bristles, a brush head which is fixed thereto and provided with a handle, and a dust-collector head which preferably contains a suction connection. The brush body is a rubber plate, pierced by the limbs of elastic, U-shaped metal wire bristles which are fixed to the brush body and inclined toward the direction of pull of the brush. The bristles form an angle of 5–15° (α) in relation to an orientation which is perpendicular to the plane of the brush body. The limbs which form part of the U-shaped bristles have a plastic coating or similar, at least on the free, protruding ends.

6 Claims, 2 Drawing Sheets

CARPET-CLEANING BRUSH

This application is a continuation of International Application No. PCT/HU00/00032 filed on Apr. 13, 2000, which International Application was not published by the International Bureau in English.

BACKGROUND OF THE INVENTION

1. Field of the Invention

The invention relates to a carpet-cleaning brush for the cleaning of rugs and carpets which have been soiled by animals kept in the room, the brush body which receives and fixes the metal bristles, as well as the brush head which is fixed to the body and provided with a connection for the handle and a dust-collector with a suction pipe end.

2. Background Art

Many kinds of brushes are known for the removal of hair that has fallen out from furred animals. Generally known are cleaning gloves having rubber bristles protruding from a rubber surface by which the lost hair of animals can be collected. However, these gloves are not suitable for the cleaning of carpets because of their small size and low efficiency.

The patent document DE 195 00 008 discloses a brush which is essentially suitable for the removal of the hair of animals and decreases the necessary display of strength and is provided with a handle. Bristles of this brush are made of stiff wire or of plastic.

U.S. Pat. No. 4.044.724 represents a brush suitable for disinfecting of the fur of animals and for dusting it with disinfecting powder. The free end of the bristles of the brush is made of wire and is bent into the direction of pull. These brushes serve exclusively for the treating of the surface of the skin and the fur of animals and thus they are entirely unsuitable for the cleaning of carpets.

Patent Document German Democratic Republic Patentschrift 35,071 presents a brush for a quick removal of pieces of threads and similar particles of dirt from clothes, fabrics and rugs. The bristles of the brush are made of plastic, have the shape of small hooks and are arranged so that during the process of brushing they form an angle of 90° with the surface to be cleaned. However, these brushes are only seldom used, as they are suitable only for the cleaning of the surface of carpets.

The presented types of brushes cannot be used for the cleaning of carpets because they have no connection for a dust collector, which is necessary for a larger quantity of dust.

Patent document DE 41 12 382 discloses a sweeping device arranged in a housing. The device contains bristle rollers rotated by wheels running on the carpet. The bristles arranged on the rollers are bent in the operating direction and in the consequence of rolling they clean the surface of the carpets whereas the dust particles are sprinkled into a container arranged in the housing. Their disadvantage is that the bristles cannot pick up the very short particles of dirt entwining the fibers of the carpet and the hair of animals that has been trampled into the carpet.

Finally, brushes fitted to the suction head of vacuum cleaners are also used for cleaning carpets.

The patent document DE 41 12 382 also describes roller sweeping devices which can be fitted to a vacuum cleaner. Very small particles of threads sticking between the bristles are removed in the upper part of the housing through the suction effect of the cleaner.

Vacuum cleaners of commercial design are provided with carpet brushes having bristles which encircle the suction opening of the suction head. To spare the carpet, these bristles are usually made of horsehair or similar materials. Dirt is being removed also in the upper part of the brush.

The disadvantage of this solution is that the suction surface encircled by the bristles does not separate the accumulated dust and pieces of hair so that when the suction head of the cleaner is being pulled onwards on the carpet the suction pipe of the cleaner is choked within a short time.

SUMMARY OF THE INVENTION

An aim of the invention is to provide a carpet-cleaning brush which removes the dust from within the carpet and from the carpet surface efficiently, rapidly and reliably.

According to the above aim, the invention relates to a carpet-cleaning brush preferably for cleaning rugs and carpets soiled by the hair of animals kept in the room. The brush contains bristles bent in the shape of an angle or an arc in the direction of pull of the brush, a brush body receiving said bristles, a brush head fixed on the brush body, a handle and a connection for the dust-collector.

The essence of the invention consists in that on the longitudinal side of the brush head in the direction of pull of the brush on the brush body receiving the bristles there is a housing narrowing in the direction of pull with a limited open mouth provided with a connection for the dust collector and the interior surfaces of the housing bordering the mouth on its longitudinal side are designed as a dust-feeding shovel.

According to the invention it is advantageous if the textile brush is coated with a velvet like textile fabric whose fibers are arranged slantwise in relation to the direction of pull of the brush. This brush is located on the surface of the brush head opposite to the brush body.

The use of the carpet-cleaning brush is made easier if on both shorter sides of the brush body connection elements are provided the handle. The handle is connected to the said fixing elements. In relation to the plane of the brush head the handle forms an angle of 30–45° in the direction of pull of the brush. The carpet-cleaning brush according to the invention is extraordinarily efficient if the narrowing end of the funnel shaped housing of the dust-collector on the brush head is provided with a suction pipe end whereas the lower exterior surface is provided with at least one supporting wheel.

The carpet-cleaning brush according to the invention is equipped with such bristles, which pick up from the carpet even the hair trampled into the carpet up to the knotted base of the carpet fibers and at the same time loosen the particles of dust. The spring force of the elastic bristles sweeps the particles of dust through the dust-feeding shovel into the connection of the dust-collector, whereas the hair which when collected has veil-like characteristics can easily be removed from the bristles by hand.

By simply pulling the carpet-cleaning brush along on the carpet even the smallest pieces of hair and particles of dust can be removed from the carpet.

The invention also makes it possible to separate the particles of dust from the hair of animals by means of a vacuum cleaner. The hair is fixed by the bristles pierced slantwise through the brush head, whereas the particles of dust are whirled alone by the suction through the mouth onto the dust-feeding shovel and from there into the dust bag of the vacuum cleaner. The hair can be entirely removed from the bristles by hand. Owing to the separation of the dust from the hair, the suction pipe of the vacuum cleaner never gets choked, as no hair of animals can get into it.

BRIEF DESCRIPTION OF THE DRAWINGS

The detailed description of the invention is following on the base of the attached drawings.

DETAILED DESCRIPTION OF EMBODIMENTS OF THE INVENTION

Figure 1:
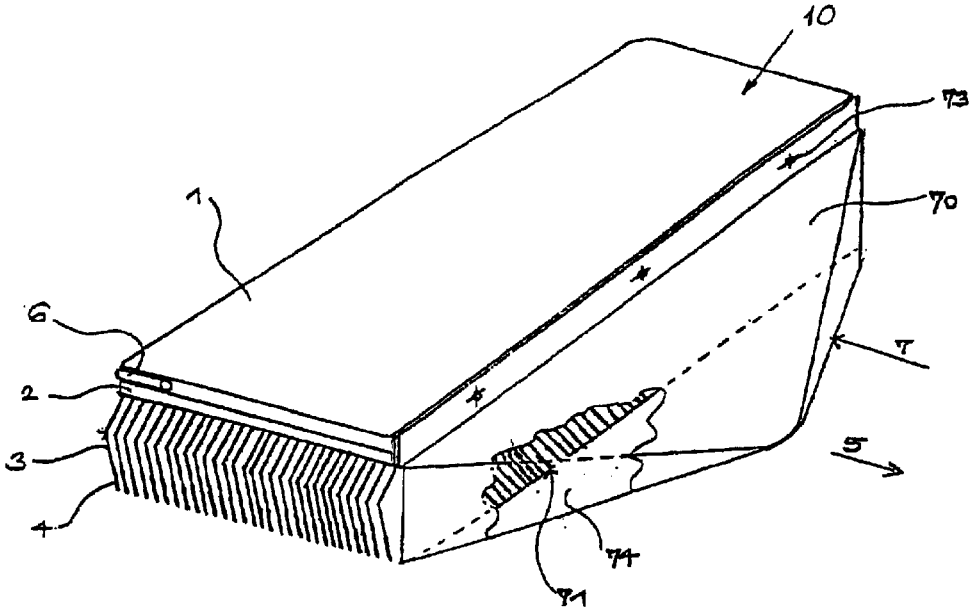
FIG. 1 is the perspective, partly split, picture of the carpet-cleaning brush according to the invention.

The embodiment of the carpet-cleaning brush presented in FIG. 1 basically consists of a brush 10 and the pipe end of the dust collector 7 integrated with it.

The brush 10 contains the brush head 1, the brush body 2 connected with it, in which the bristles 3 are arranged by piercing. The brush head 1 is produced of wood, plastic or similar material, whereas the brush body 2 is made of a rubber plate or a similar elastic material. The protruding bristles 3 are made of metal wire as U-shaped limbs. The elastic U-shaped bristles 3 of metal wire are fixed to the brush body and inclined in the direction of arrow 5 indicating the direction of pull of the brush. The bristles 3 form an angle of 5–15° ($\alpha$) in relation to an orientation perpendicular to the plane of the brush body 2, as seen in for example. FIG. 1. Bristles 3 protruding through the brush head of a rubber plate are bent in the form of an angle or an arc also in the direction of pull marked by arrow 5. Bristles 3 are coated with plastic or a similar material 4 at least on their free end. The U-shaped metal wire bristles 3 are arranged in the brush body 2 of rubber plate in longitudinally parallel rows in a distance u from each other between the U-shaped limbs. The rows of bristles are displaced in relation to each other. They are fixed by piercing through brush body 2.

The pipe end 7 of the dust collectors is bordered by the housing 70 which narrows in the direction of pull marked by arrow 5. The pipe end 7 of the dust collector having a mouth 71 open in the direction of the bristles 3 is connected with brush head 1 and brush body 2 keeping the bristles in the direction 5 of pull of the brush. The interior surface of the housing 70 bordering the mouth 71 on the long side is designed as a dust-feeding shovel 74. Both shorter sides of the brush head 1 are provided with a connecting part 6 receiving the cylindrical ends of the generally used handle 9 which forms an angle with the plane of the brush head of 30–45°. The fork/support 90 of the handle can be fixed in the connector 6 and released by snapping to form a releasable joint.

The brush corresponding to the above-described invention shall be equipped with the handle 9 prior to use. The support 90 of the handle 9 can be snapped into the connector 6 arranged on the short side of the brush head. After the supports 90 have been snapped into place, the handle 9 has to be screwed in. The ready for use carpet-cleaning brush has to be pulled on the surface of the soiled carpet in the direction of arrow 5. The bristles 3, which are made of an elastic material, protrude deeply into the carpet between the knotted fibers and, together with the dust, they also pick up animal hair which when picked up has veil-like characteristics. The particles of dust are swept by the spring force of the bristles 3 through the dust-feeding shovel 74 into the pipe end 7 of the dust collector. The dust particles are removed from there by releasing the connecting parts 73 between the brush head 2 and the pipe end 7 of the dust collector. The hair delivered from the dust must be from time to time removed from the bristles 3 by hand.

Figure 2:
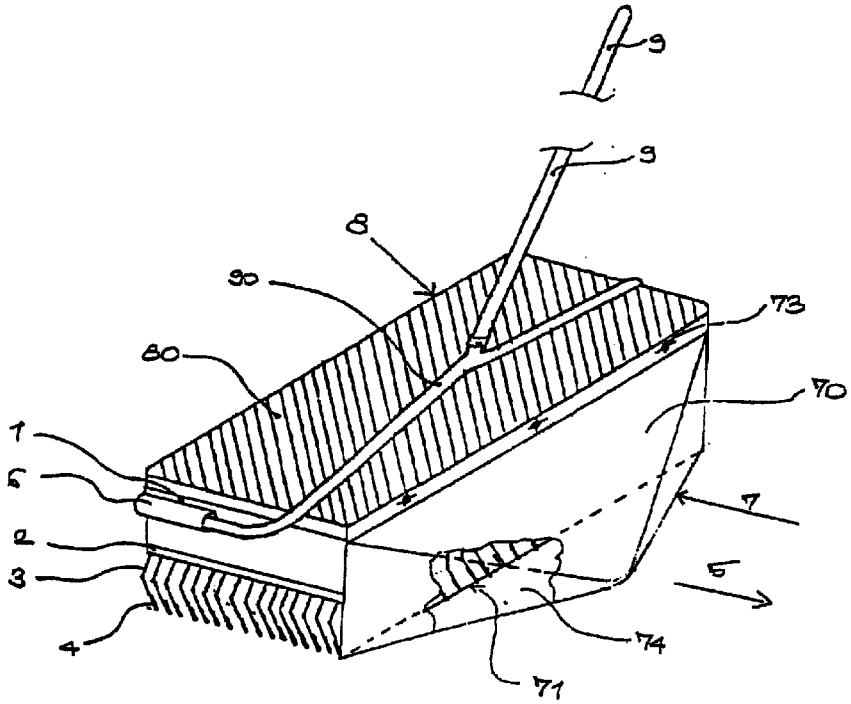
FIG. 2 is the perspective view of the carpet-cleaning brush according to another embodiment, whose brush head is made as a textile brush of textile cloth.
Figure 3:
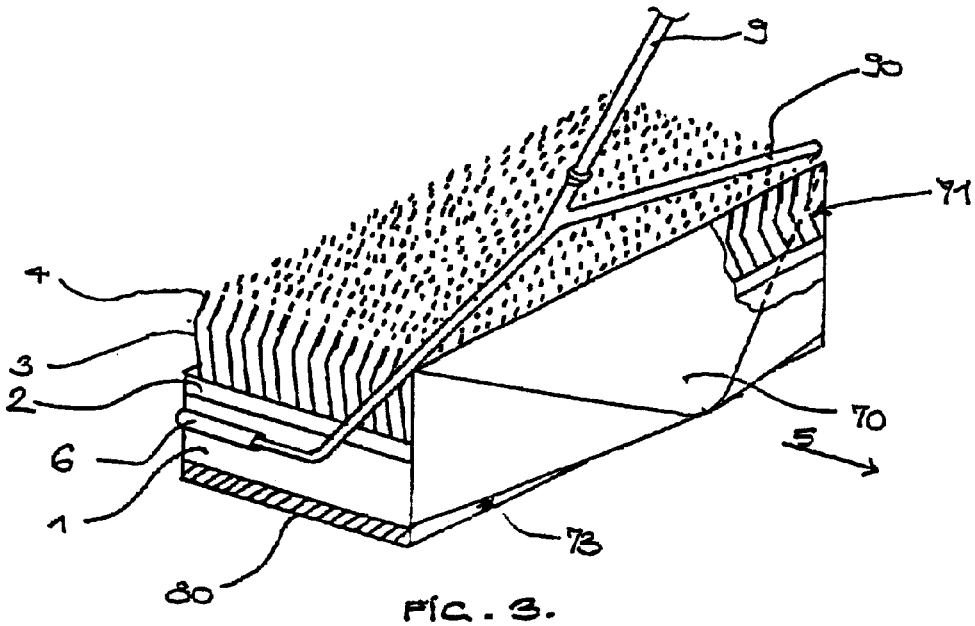
FIG. 3 represents the perspective view of the brush according to FIG. 2 after having been turned.

The embodiments of the carpet-cleaning brush according to FIG. 2 and 3 differ from the embodiment described above in that the upper surface of brush head 1 opposite to the brush body 2 is provided with an elastic pad—rubber or sponge—coated with a velvet like cloth 80 to form a textile brush 8. The rigid fibers of the cloth 80 are inclined in the direction of pull of the brush indicated by arrow 5. This embodiment of the invention principally consists of two brush surfaces—one is a springy fixed brush 10 with metal bristles 3 coated with plastic, and the other is a textile brush 8 on an elastic pad. The brush surface you want to use must just be put on the surface of the carpet.

The double carpet-cleaning brush described above prior to use must be fitted with the handle 9 according to FIG. 2 and 3. After use of the brush with the bristle-side toward the carpet, the hair and dust particles still sticking to the surface of the carpet can be removed in the following way. Support 90 belonging to the handle 9 according to FIG. 2 is released from the connector 6 and then the carpet-cleaning brush is turned into the position according to FIG. 3 so the textile brush 8 contacts the surface of the carpet. Then the support 90 is snapped into the connector 6, and the carpet can be cleaned by pulling the carpet-cleaning brush along on the surface of the carpet. Hair and particles of dust remain sticking to the surface of the textile brush 8 and can be easily removed from there.

In case of less soiled carpets you can just clean the carpet with the textile brush 8 assembled according to FIG. 3 and then remove the small curled rolls of hair by means of the carpet-cleaning brush with the plastic coated wire bristles 3.

Figure 4:
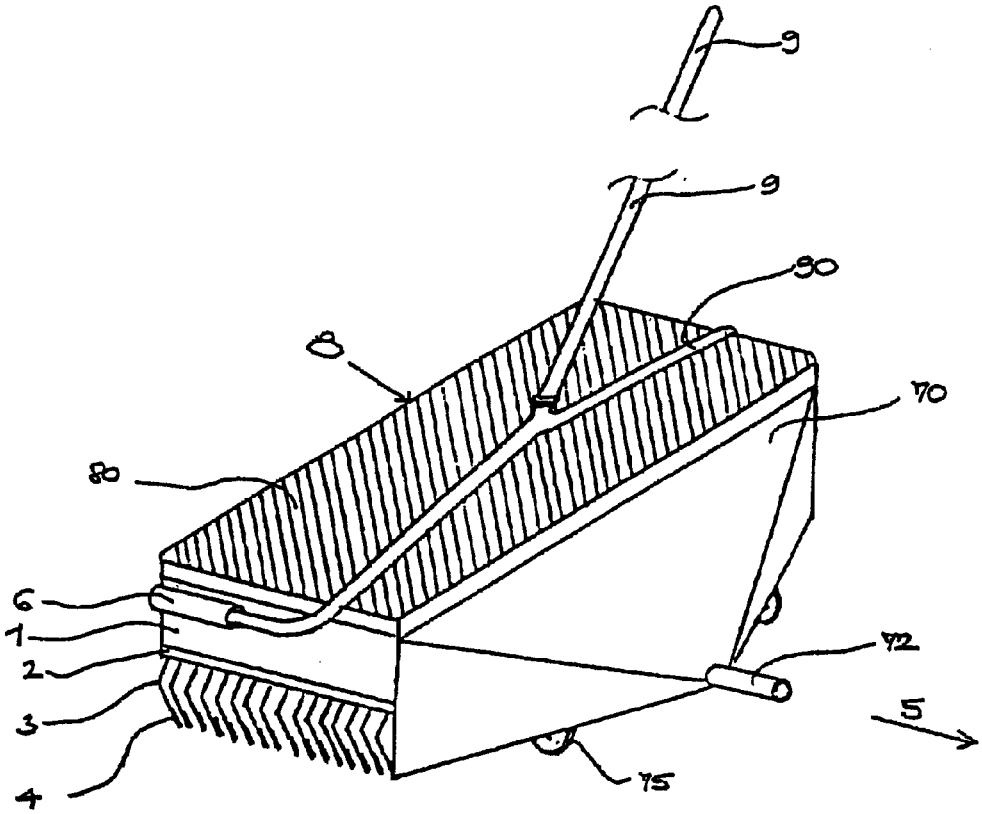
FIG. 4 is the perspective view of a carpet-cleaning brush according to an embodiment of the invention, which can be connected to the suction side of a vacuum cleaner.

A further embodiment of the invention is presented in FIG. 4. With this embodiment the carpet cleaning brush is equipped with a pipe end 7 for the vacuum cleaner on the suction side.

Finally to make easier moving of the carpet-cleaning brush with said embodiment the lower exterior surface of the housing 70 is provided with the supporting wheels 75.

The carpet-cleaning brush according to FIG. 4 is preferably used so that by means of the suction pipe end 72 the brush is connected to the dust collector pipe end 7 of a vacuum cleaner not indicated in FIG. 4. After the start of the vacuum cleaner when the carpet-cleaning brush is being pulled on the surface of the carpet in the direction according to arrow 5 the bristles pick up the hair between the knotted fibers of the carpet and remove them, whereas the vacuum-cleaner transfers the dust particles swept onto the dust-feeding shovel into the dust bag of the vacuum cleaner which is not represented in FIG. 4. Consequently, during the operation of the carpet-cleaning brush bristles 3 retain the veil like texture created by the hair, whereas under the suction effect of the vacuum cleaner the dust is being transferred into the dust bag. Thus the veil like texture created by the pieces of hair cannot get into the vacuum cleaner and so choking of the suction pipe is impossible. After the cleaning of the carpet said texture can be easily removed from the bristles by hand, without any tool.

The great advantage of the carpet-cleaning brush according to the invention is that carpets soiled by dust and animal hair can be easily, quickly and efficiently cleaned with a minimal display of strength.

What is claimed is:

1. A carpet-cleaning brush to be pulled in a direction to clean rugs and carpets soiled by animals comprising:

bristles configured so that at least a portion of the bristles extend toward the pull direction of the brush, a brush body receiving the bristles, a brush head fitted to the brush body, a handle for pulling the brush in the pull direction, and a dust collector having a housing, wherein a first side of the brush head facing in the pull direction of the brush and the brush body are connected to the housing of the dust collector, wherein the housing narrows in the pull direction of the brush and has an open mouth with a longitudinal bordering interior surface positioned adjacent the brush body.

2. The carpet-cleaning brush according to claim 1 wherein a surface of the brush head opposite from the brush body is formed as a textile brush comprising a textile fabric on an elastic pad, wherein fibers of the textile fabric are arranged slantwise with respect to the pull direction of the brush.

3. The carpet-cleaning brush according to claim 1 wherein the brush head has two shorter sides that are shorter in length than the first side, wherein the brush head includes a connecting element on each of the shorter sides forming a releasable joint, and wherein the handle is connected to each of the connecting elements, is inclined in the pull direction, and forms an angle of 30–45° with an upper surface of the brush head.

4. The carpet-cleaning brush according to claim 1 wherein the housing narrows toward an end at which is provided a suction pipe end and a lower exterior surface of the housing is equipped with a supporting wheel.

5. The carpet-cleaning brush according to claim 1 wherein the bristles are bent at an angle.

6. The carpet-cleaning brush according to claim 1 wherein the bristles are configured as an arc.

* * * * *